US007478581B2

(12) United States Patent
Price

(10) Patent No.: US 7,478,581 B2
(45) Date of Patent: Jan. 20, 2009

(54) METHOD OF AMELIORATING AN END OF STROKE EFFECT IN AN IMPLEMENT SYSTEM OF A MACHINE AND MACHINE USING SAME

(75) Inventor: Robert J. Price, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 306 days.

(21) Appl. No.: 11/301,008

(22) Filed: Dec. 12, 2005

(65) Prior Publication Data

US 2007/0130928 A1 Jun. 14, 2007

(51) Int. Cl.
*E02F 3/42* (2006.01)
*E02F 9/20* (2006.01)

(52) U.S. Cl. ..... 91/513; 60/469

(58) Field of Classification Search ..... 91/511, 91/512, 513, 517; 60/327, 469, 484
See application file for complete search history.

(56) References Cited

U.S. PATENT DOCUMENTS 4,358,989 A 11/1982 Tordenmalm
5,511,458 A 4/1996 Kamata et al.
5,546,847 A 8/1996 Rector et al.
5,899,008 A 5/1999 Cobo et al.
6,047,228 A * 4/2000 Stone et al. ..... 701/50
6,257,118 B1 7/2001 Wilbur et al.
6,568,763 B2 5/2003 Uematsu et al.

FOREIGN PATENT DOCUMENTS

JP 58120925 A * 7/1983

OTHER PUBLICATIONS

English Translatoin of Hiroshi (JP 58120925A) Jul. 2008.*

* cited by examiner

*Primary Examiner*—Thomas E Lazo
(74) *Attorney, Agent, or Firm*—Liell & McNeil

(57) ABSTRACT

A method of operating a work machine includes moving a work implement via a first actuator having a range of motion, and ameliorating an end of stroke effect on a second actuator if an end of stroke condition of the first actuator is sensed. A work machine includes an electronic controller having software control logic for sensing a stroke condition of an actuator in a work implement system, and for ameliorating an end of stroke effect on a hydraulic actuator of the work implement system if an end of stroke condition of a first actuator is sensed.

20 Claims, 2 Drawing Sheets

METHOD OF AMELIORATING AN END OF STROKE EFFECT IN AN IMPLEMENT SYSTEM OF A MACHINE AND MACHINE USING SAME

TECHNICAL FIELD

The present disclosure relates generally to methods of operating and/or controlling a work machine implement system, and relates more particularly to a method of ameliorating an end of stroke effect in a work implement system as an actuator of the system approaches an end of stroke position.

BACKGROUND

Many modern work machines employ hydraulically actuated work implement systems. In a typical design, one or more work implements are coupled to a linkage having actuators operable to extend, retract, tilt or otherwise move the linkage as commanded by an operator or electronic controller. In the case of a backhoe, excavator or similar work machine, the linkage includes a set of actuators for independently moving or controlling the separate linkage components.

Such work machines typically include a hydraulic system having a hydraulic pump powered by an internal combustion engine or other power source and a plurality of hydraulic actuators. Fluid pressurized by the pump may be delivered to or evacuated from the respective actuators to manipulate the linkage components. A backhoe, for example, will typically include three main linkage components, a boom, a stick and a bucket, each having at least one hydraulic actuator fluidly coupled with an implement pump of the work machine. While the respective actuators are separately controlled, it is typical for a common mechanical, pilot or electronically actuated valve to affect fluid flow to more than one actuator in the system. Therefore, the behavior of one actuator can affect fluid flow to another actuator or another part of the hydraulic system.

For example, when one of the actuators reaches an extended or retracted end of its range of motion, a relatively sudden interruption in fluid flow to or from the respective actuator can cause a pressure spike that travels elsewhere in the system. In other words, as an actuator reaches an end of its stroke, fluid flow to or from the actuator can suddenly halt as the actuator piston contacts the end of its cylinder housing. This sudden cessation of fluid flow can affect other components of the hydraulic system, similar to the "water hammer" effect common in plumbing systems, causing lurching of the work machine linkage or the work machine body itself. When a work machine is used for tasks such as positioning loads on a truck or grading soil or rock with the implement system, such a disruption can compromise the operation. The more delicate the task, the less tolerance there is for unpredictability in operation.

Operators will often attempt to avoid end of stroke effects while operating a work machine by easing off of the linkage controls prior to the linkage actuator reaching an end of its stroke. While some problems can be avoided by such manual control, the range of motion of the linkage is thereby limited, as is the efficiency of the operation. Even highly skilled operators are typically incapable of maximizing efficiency and range of motion in such instances.

Design engineers have dealt with the aforementioned problems in a variety of ways. One known method of addressing end of stroke problems is through the use of a spring or other cushion positioned internally in a hydraulic cylinder. In such a design, the hydraulic cylinder rod encounters a resistance as it approaches its end of stroke position and slows accordingly, attenuating the production of pressure spikes that may cause undesirable motion from actuators elsewhere in the system. One drawback to this approach is that there are instances where it is desirable to abruptly stop the hydraulic actuator at the end of its stroke, for example, where a sudden jarring is desirable to knock work material off of the bucket of a work machine linkage. Where a spring or similar cushion is used, the operator is less able to perform such an operation.

Other systems have been developed wherein hydraulic fluid flow to an actuator is slowed in response to the actuator approaching its end of stroke position. One such system is disclosed in U.S. Pat. No. 5,511,458 to Kamata et al. ("Kamata"). Kamata discloses an automatic cushioning control apparatus for a cylinder of a work machine that purportedly reduces shaking of the vehicle. The apparatus includes means for detecting travel direction and position of a cylinder, and for computing lever gain with respect to a signal from a control lever. A computer subsequently controls driving of the cylinder in accordance with these factors.

While Kamata and similar designs may offer improvements in performance and operator comfort in some instances, they are not without drawbacks. In particular, Kamata controls fluid flow to only one actuator of the system, and is thus unable to address effects elsewhere in the work machine hydraulic system when the actuator of interest reaches or approaches an end of its stroke.

The present disclosure is directed to one or more of the problems or shortcomings set forth above.

SUMMARY OF THE INVENTION

In one aspect, the present disclosure provides a method of operating a work machine, including the step of moving a work implement via a first actuator of the work implement system, wherein the actuator has a range of motion. The method further includes sensing a stroke condition of the first actuator, and ameliorating an end of stroke effect on at least one other actuator of the work implement system, if an end of stroke condition of the first actuator is sensed.

In another aspect, the present disclosure provides a work machine including a work implement system having a linkage, a work implement connected with the linkage, and first and second actuators operably coupled with the linkage. The work machine further includes an electronic controller including means for sensing a stroke condition of the first actuator, and means for ameliorating an end of stroke effect on the second actuator, if an end of stroke condition of the first actuator is sensed.

In still another aspect, the present disclosure provides an electronic controller, including means for sensing a stroke condition of an actuator in a work implement system of a work machine, and means for ameliorating an end of stroke effect on at least one other actuator of the work implement system where an end of stroke condition is sensed.

DETAILED DESCRIPTION

Figure 1:
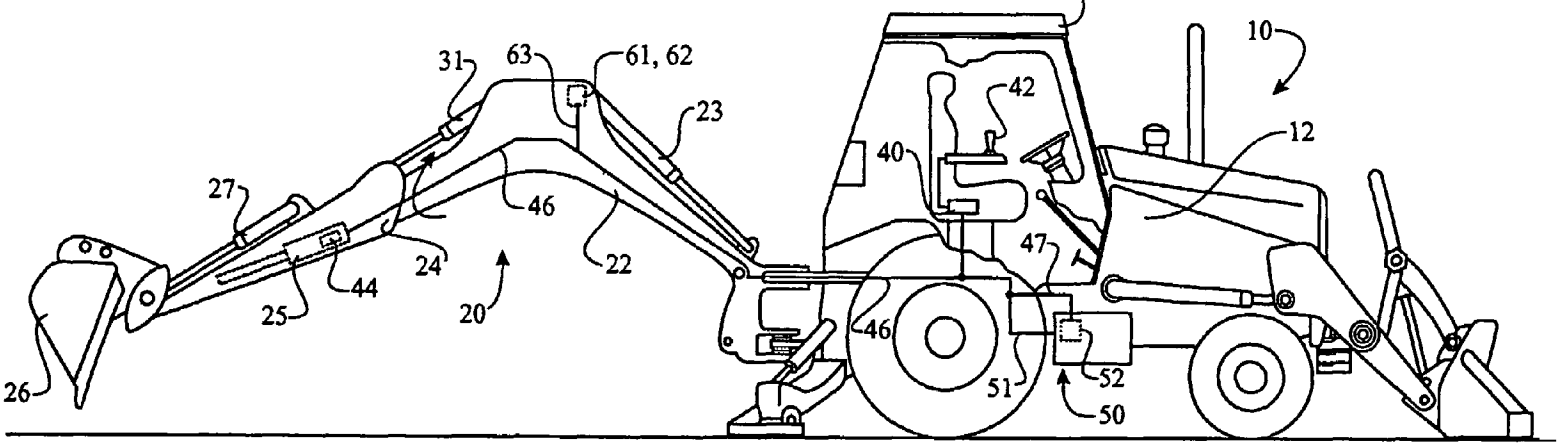
FIG. 1 is a side diagrammatic view of one embodiment of a work machine having a work implement system, in accordance with the present disclosure.

Referring to FIG. 1, there is shown a work machine 10 according to one embodiment of the present disclosure. Work machine 10 is shown in the context of a backhoe loader having a hydraulically actuated linkage 20. However, it should be appreciated that a variety of other work machines, such as a telehandler or an excavator, might fall within the scope of the present disclosure. Similarly, other work machines having implement systems with two or more fluid pressure actuators are also contemplated herein. Work machine 10 is shown in FIG. 1 with linkage 20 extended, approximately in a position it would occupy having just completed a stroke in a process of grading a work material such as soil or gravel.

Work machine 10 further includes a work machine body 12 including an operator cabin 30 wherein a joystick 42 or other type of operator input device is positioned. Linkage 20 may include a boom 22 having at least one associated boom actuator 23, a stick 24 movably coupled with boom 22 and having a stick tilt actuator 31, and an estick actuator 25. Linkage 20 further includes a bucket 26 and bucket actuator 27. In a typical configuration, estick actuator 25 may reach an end of its stroke prior to either of boom actuator 23 or bucket actuator 27 when linkage 20 is extended outwardly from work machine 10, as shown in FIG. 1. It should be appreciated, however, that in certain work machine operations, or with certain linkage configurations, one of the actuators other than estick actuator 25 might reach an end of its stroke prior to estick actuator 25. The present disclosure is discussed primarily in the context of extending linkage 20 outwardly from work machine 10 above a work surface. However, those skilled in the art will appreciate that control of operations other than those specifically described herein will also fall within the scope of the present disclosure.

Work machine 10 further includes a hydraulic system 50 fluidly coupled with each of actuators 23, 25 and 27 and in communication via a communication line 51 with an electronic controller 40. Electronic controller 40 is operable to control hydraulic system 50 responsive to operator commands via joystick 42, or automatically as described herein. One or more flow control valves may be disposed within hydraulic system 50 to control hydraulic fluid flow or pressure to actuators 23, 25 and 27. For example, electronically controlled flow control valves 61 and 62 are shown coupled with boom actuator 23 and in communication with electronic controller 40 via a communication line 63. A position sensor 44 will typically be coupled with estick actuator 25 and operable to output a position signal to electronic controller 40 via a second communication line 47. Additional position sensors may be associated with actuators 23 and 27 in other embodiments.

An adjustable snubbing valve 52 is shown coupled with hydraulic system 50 and with electronic controller 40 by a third communication line 47. Snubbing valve 52 is operable to controllably snub actuator 25 as it approaches an end of stroke position in its range of motion. Controlled snubbing of actuator 25 at a selected rate via valve 52 will limit pressure and fluid flow changes induced in system 50 when actuator 25 reaches an end of stroke position of its range of motion, in particular limiting pressure spikes which can cause linkage 20 to lurch. In addition, the controlled snubbing of actuator 25 will slow its travel, allowing electronic controller 40 or an operator time to compensate for fluid flow or pressure changes induced elsewhere in the system by actuator 25 as it reaches an end of stroke position of its range of motion. In this manner, not only may unwanted lurching or jerking of work machine 10 and linkage 20 be reduced or eliminated, control over actuators 23 and 27 may continue essentially uninterrupted. When performing a grading operation, for example, once actuator 25 reaches an end of its stroke during a pass across a work material bed, an operator or controller may continue to effectively control the bucket and boom within the extent of their respective actuator strokes.

One means of compensating for flow and pressure changes induced by an end of stroke condition of actuator 25 may be via valves 61 and 62, typically after controlled snubbing of actuator 25 is initiated. Valves 61 and 62 may be controlled to limit the rate of increase in fluid flow to actuator 23. For example, valves 61 and 62 may limit the rate of increase to be that existing prior to actuator 25 reaching its end of stroke position. Alternatively, valves 61 and 62 may limit the rate of increase to be about zero. Other electronically controlled flow control valves (not shown) may be associated with bucket actuator 27. The output of the implement pump, described herein, might also be controlled. In one embodiment, electronic controller 40 may limit the hydraulic flow to boom actuator 23 and/or bucket actuator 27 to a rate that is about the same as the rate prior to estick actuator 25 reaching an end of its stroke, until the operator moves a boom or bucket control lever to request additional flow or actuator speed.

Figure 2:
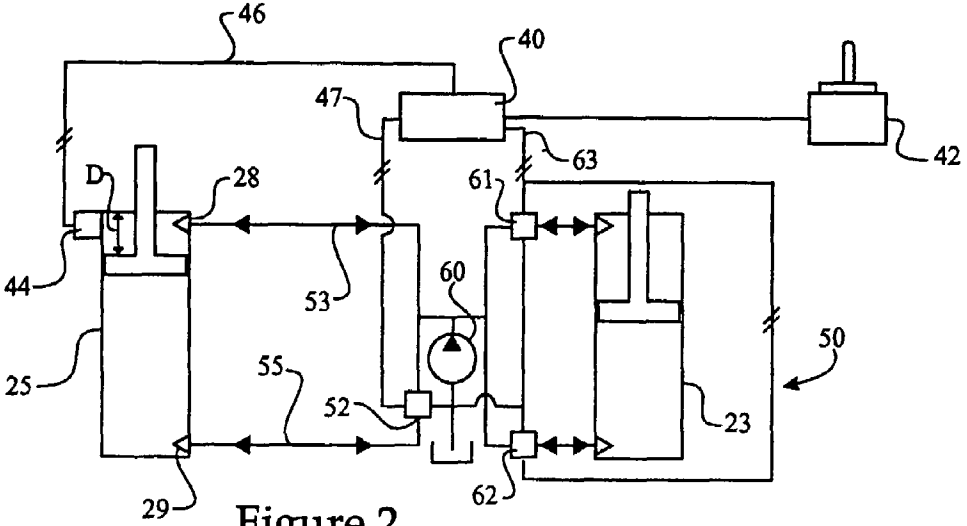
FIG. 2 is a schematic illustration of a portion of a hydraulic work implement system suitable for use in the work machine of FIG. 1.

Referring also to FIG. 2, there is shown schematically a portion of work machine 10 of FIG. 1, including hydraulic system 50. Hydraulic system 50 will typically include a hydraulic implement pump 60 which is fluidly connected with supply/discharge ports 28 and 29 of estick actuator 25 via first and second hydraulic lines 53 and 55. Pump 60 will further typically be fluidly connected with boom actuator 23 and bucket actuator 27 (not shown in FIG. 2).

Electronic controller 40 may be operable to controllably snub actuator 25 as it approaches an end of stroke position, approximately as shown in FIG. 2. In the embodiment of FIG. 2, snubbing valve 52 is shown disposed between pump 60 and port 29. In such a configuration, snubbing valve 52 will be operable to limit pressure or flow of hydraulic fluid that is delivered to actuator 25. Electronic controller 40 may further be operable to initiate snubbing of actuator 25 when a stroke condition such as an end of stroke condition of actuator 25 is sensed at least in part via sensor 44.

It should be appreciated that while position sensor 44 is shown positioned adjacent one end of actuator 25, the illustration is exemplary only. Further, snubbing valve 52 may be positioned elsewhere in the system, and might be operable to control flow of hydraulic fluid from, rather than to, actuator 25. Moreover, separate snubbing valves may be used at each end of the range of motion of actuator 25 and associated with each supply/discharge port 28 and 29. In other words, actuator 25 may be controllably snubbed as it approaches an extended end of stroke position, and may also be controllably snubbed as it approaches a retracted end of stroke position, depending upon the particular application. A wide variety of suitable adjustable snubbing valves known in the art may be used, such as a solenoid operated snubbing valve having one or more flow restricting orifices. Other known valve types, including any suitable adjustable flow valve might be used in certain embodiments.

It is contemplated that position sensor 44 may provide one practical implementation strategy for determining position, direction and velocity of actuator 25 as described herein. However, the present disclosure is by no means thereby limited. For example, rather than a position sensor, electronic controller 40 might utilize inputs from joystick 42 to determine or estimate the stroke condition of actuator 25, and thereby initiate controlled snubbing thereof.

The present disclosure further provides a method of operating a work implement system, including the step of moving a work implement via a first actuator of the work implement system having a range of motion. In the context of work machine 10 of FIG. 1, stick 24 may be moved via actuator 25, which includes a range of motion between an extended and a retracted position. The method may further include the step of sensing a stroke condition of the first actuator, e.g. sensing a position, velocity and travel direction of actuator 25. The sensing step may be implemented in work machine 10 via signals from sensor 44 to electronic controller 40, allowing position, velocity and travel direction to be determined in a conventional manner. For instance, multiple position signals from sensor 44 in a given time increment may be used to determine a value indicative of a velocity of actuator 25. Other means for determining values indicative of velocity and/or position, as well as travel direction are known in the art.

The operating method described herein may further include the step of ameliorating an end of stroke effect on at least one other actuator of the work implement system, if an end of stroke condition of the first actuator is sensed. Thus, rather than allowing the head of actuator 25 to ram full speed into its housing and increase the fluid pressure or flow to actuator 23 via pressure spikes and/or other pressure rises, as commonly occurs in conventional systems, the fluid pressure changes at actuator 23 are reduced in severity or eliminated altogether.

While the term "end of stroke condition" is discussed herein primarily in the context of actuator 25 reaching a predetermined portion of its range of motion, for example, entering range D shown in FIG. 2 during actuator extension, other situations may fulfill this condition. For instance, in one embodiment, an end of stroke condition may be determined based on both position and velocity. Where actuator 25 approaches an end of its stroke at a relatively higher velocity, the pressure changes at actuator 25 may be relatively large and, hence, amelioration desirable. At relatively lower velocities, amelioration may be unnecessary. In addition, the position of actuator 25 at which amelioration of an end of stroke effect is initiated may vary based on actuator velocity. At relatively higher velocities of actuator 25, it may also be desirable to begin controllably snubbing actuator 25 at a position that is relatively further from its end of stroke, for instance before actuator 25 enters range D. At relatively lower velocities, snubbing of actuator 25 may begin relatively closer to the end of its stroke. Thus, the term "end of stroke condition" may be defined in a variety of ways, taking into account various factors, such as position, velocity, travel direction, linkage load, etc. As used herein, the term "end of stroke condition" should be understood generally as a condition, or set of conditions, of one actuator which can or will give rise to a pressure spike which alters motion or controllability of another actuator.

The step of ameliorating the end of stroke effect may further include the step of controlling hydraulic fluid pressure or flow to actuator 23 and/or actuator 27 when actuator 25 approaches an end of its stroke. For simplicity, the present description primarily discusses end of stroke effects on actuator 23, however, it should be appreciated that the present discussion is equally applicable to end of stroke effects on actuator 27. The end of stroke effects on pressure, flow forces, linkage inertia, etc. have been generally found to be predictable based on experimental testing, hydraulic models and linkage kinematic relationships. Thus, in the step of controlling fluid pressure or flow to the second actuator, e.g. actuator 23, the fluid pressure or flow may be controlled based on these known or ascertainable factors, and the desired or acceptable level of response, if any, of actuator 23 to actuator 25 reaching an end of its stroke.

The step of controlling the fluid pressure or flow to actuator 23 may thus account for various operating factors, which may then serve as a basis for selecting a snubbing rate for actuator 25. In other words, known or estimated effects on actuator 23 (or another part of work machine 10) may serve as the basis for selecting the snubbing rate of actuator 25. In one embodiment, the snubbing rate may be mapped to velocity of actuator 25, wherein the velocity of actuator 25 has a known relationship with the response of actuator 23 to an end of stroke condition of actuator 25. Rather than a mapped value, however, the snubbing rate of actuator 25 may be determined by curve fitting via a snubbing rate curve based at least in part on a direction, position and determined velocity of actuator 25, for example.

As described herein, during and/or after controlling fluid pressure or flow induced in actuator 23 due to actuator 25 reaching an end of stroke condition, electronic controller 40 may also directly control fluid pressure or flow elsewhere in work machine 10, for instance, via a step of controlling valves 61 and 62. In such an embodiment, an increase in hydraulic fluid flow or pressure to actuator 23 where an end of stroke condition is sensed may simply be set to a predetermined limit, for example, a predetermined position or rate of change in position of valve 61 or 62. The rate of increase in flow or pressure to actuator 23 might be limited to be about zero, or limited to the rate of increase existing prior to actuator 25 reaching an end of stroke condition.

Implementation of the above process may take place via software control logic stored in electronic controller 40, such as a control algorithm recorded on a computer readable medium such as RAM, ROM or another suitable medium. Rather than a pure software based system, however, certain aspects of the control process described herein may be carried out via dedicated hardware. In either event, however, electronic controller 40 may include means for sensing a stroke condition of actuator 25, and means for ameliorating an end of stroke effect on actuator 23, if an end of stroke condition of actuator 25 is sensed. The means for ameliorating may further include means for controlling hydraulic fluid pressure or flow to boom actuator 23 at least in part by slowing estick actuator 25 as it approaches an end of its stroke. The means for controlling may include means for controllably snubbing estick actuator 25 via valve 52.

INDUSTRIAL APPLICABILITY

A grading or work material distributing process according to the present disclosure may consist of an operator repeatedly extending and retracting the work implement to evenly distribute a work material pile. In the context of a backhoe loader work machine, it has been observed that disruptions in hydraulic pressure to one actuator due to an end of stroke effect by another actuator can cause the boom to drop suddenly or otherwise behave unpredictably. The bucket may also be affected. Such disruptions can result in ripples in the work material rather than a smooth, even surface. In particular, in a conventional system, when the estick actuator reaches the end of its stroke, the linkage can suddenly drop several inches due to the sudden addition of a portion of hydraulic flow to the boom cylinder, which had previously been supplied to estick actuator 25.

Work machine 10 and the control process described herein overcome these problems, in particular by ameliorating the end of stroke effect of estick actuator 25 on boom actuator 23.

Thus, rather than pressure spikes and sudden addition of hydraulic pressure or flow to boom actuator 23, actuator 25 is controllably snubbed, reducing pressure spikes and providing time for flow to be more gradually increased, if at all. Consequently, a smoother and more even work material surface can be prepared. A similar apparatus and control process may be used for relatively fine load handling operations, such as placing a loaded pallet onto a truck via a telehandler or similar work machine. Certain digging or trenching processes, wherein a work machine linkage is extended to where the estick actuator reaches an end of its stroke may also benefit through the teachings of the present disclosure.

Figure 3:
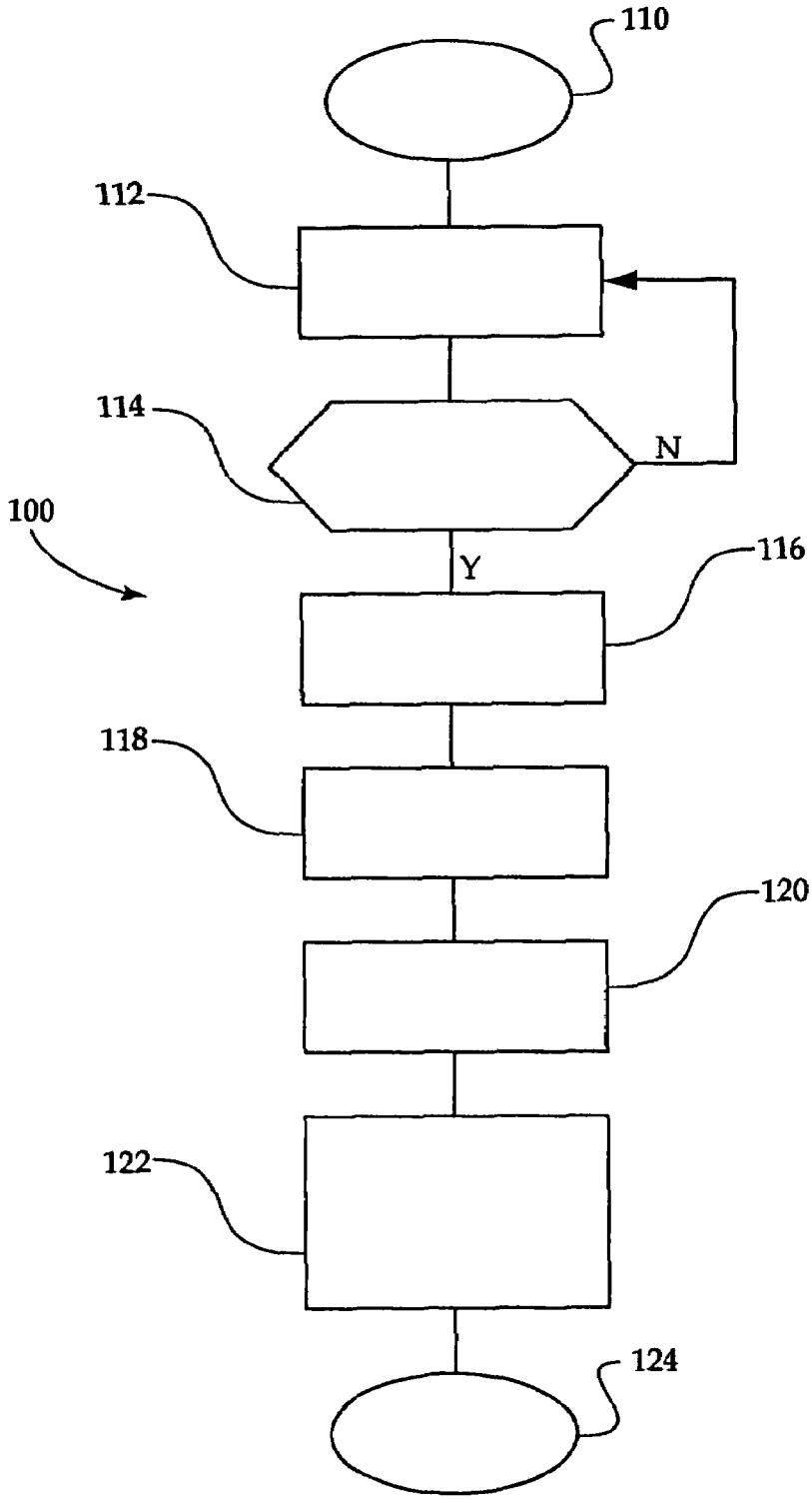
FIG. 3 is a flowchart illustrating an exemplary control process according to the present disclosure.

Referring to FIG. 3, there is shown an exemplary control process 100 according to one embodiment of the present disclosure. The process of control process 100 begins at START 110, and may then proceed to Step 112 wherein electronic controller may determine a position of estick actuator 25. From Step 112, the process may proceed to Step 114 wherein electronic controller 40 will query whether estick actuator 25 is approaching an end of its stroke. If no, the process may return to Step 112 wherein electronic controller 40 will again query whether estick actuator 25 is approaching an end of its stroke. In this manner, throughout operation electronic controller 40 may monitor a position of estick actuator 25 to determine whether it is approaching an end of its stroke and, hence, whether amelioration of an end of stroke effect may be desirable. The determination in Step 114 might consist merely of determining whether estick actuator 25 is within range D shown in FIG. 2, or it might be determined via a combination of factors.

If at Step 114 estick actuator 25 is determined to be approaching an end of its stroke, the process may proceed to Step 116 wherein electronic controller 40 may determine travel direction of estick actuator 25. From Step 116, the process may proceed to Step 118 wherein electronic controller 40 may determine a velocity of estick actuator 25, and thenceforth to Step 120 wherein electronic controller 40 determines a position of estick actuator 25. From Step 120 the process may proceed to Step 122 wherein electronic controller 40 will set the snubbing rate for actuator 25, via either curve fitting as described herein or by referencing at least one map such as a look-up table. The snubbing rate may be selected based on velocity, travel direction and position of estick actuator 25, for example. Adjustable snubbing valve 52 may thenceforth be moved to a desired position, and the process proceed to FINISH, 124.

The present disclosure is for illustrative purposes only, and should not be construed to narrow the breadth of the present disclosure in any way. Thus, those skilled in the art will appreciate that various modifications might be made to the presently disclosed embodiments without departing from the intended spirit and scope of the present disclosure. For instance, while much of the present discussion implies the use of the presently described control process in conjunction with operator control of linkage 20, it is contemplated that the teachings of the present disclosure may also be applied to an electronically controlled, or "auto-grading" process wherein electronic controller 40 commands some or all of the repetitive sweeping motions necessary to distribute a work material. In auto or manual grading, the primary end of stroke effect addressed by the present disclosure may be the effect on the boom actuator, however, the present disclosure may also provide better control over the bucket under end of stroke conditions of the estick actuator. Better control enables even less skilled operators to use the full range of potential motion of linkage 20, rather than requiring that a grading or other operation be performed at less than full range of motion to avoid end of stroke issues as in certain earlier designs. Other aspects, features and advantages will be apparent upon an examination of the attached drawings and appended claims.

What is claimed is:

1. A method of operating a machine having a work implement system comprising the steps of:

moving a work implement via a first actuator of the work implement system, the first actuator having a range of motion;

sensing a stroke condition of the first actuator; and ameliorating an end of stroke effect induced by the first actuator on at least one other actuator of the work implement system at least in part via a step of limiting increasing fluid pressure or flow to the at least one other actuator, if an end of stroke condition of the first actuator is sensed.

2. The method of claim 1 wherein the first actuator and the at least one other actuator are hydraulic actuators of a hydraulic work implement system and wherein the limiting step further comprises controlling a flow control valve for the at least one other actuator.

3. A method of operating a machine having a work implement system comprising the steps of:

moving a work implement via a first actuator of the work implement system, the first actuator having a range of motion;

sensing a stroke condition of the first actuator; and ameliorating an end of stroke effect induced by the first actuator on at least one other actuator of the work implement system at least in part via a step of limiting increasing fluid pressure or flow to the at least one other actuator, if an end of stroke condition of the first actuator is sensed;

wherein the first actuator and the at least one other actuator are hydraulic actuators of a hydraulic work implement system and wherein the limiting step further comprises controlling a flow control valve for the at least one other actuator;

wherein the limiting step comprises slowing the first actuator as it approaches an end of its stroke.

4. The method of claim 3 wherein the limiting step further comprises a step of controllably snubbing the first actuator.

5. The method of claim 4 wherein the sensing step comprises sensing at least one of a position and a relative velocity of the first actuator via a position sensor coupled with the first actuator and with an electronic controller of the machine.

6. A method of operating a machine having a work implement system comprising the steps of:

moving a work implement via a first actuator of the work implement system, the first actuator having a range of motion;

sensing a stroke condition of the first actuator; and ameliorating an end of stroke effect on at least one other actuator of the work implement system, if an end of stroke condition of the first actuator is sensed;

wherein the first actuator and the at least one other actuator are hydraulic actuators of a hydraulic work implement system, the ameliorating step comprising a step of controlling hydraulic fluid pressure or flow to the at least one other actuator;

wherein the step of controlling hydraulic fluid pressure or flow comprises slowing the first actuator as it approaches an end of its stroke; and wherein the step of controlling hydraulic fluid pressure or flow comprises a step of controllably snubbing the first actuator;

the method further comprising the step of determining a value indicative of a velocity of the first actuator as it approaches an end of its stroke, wherein the step of controlling hydraulic fluid pressure or flow to the second actuator comprises controllably snubbing the first actuator at a snubbing rate that is based at least in part on the determined value.

7. The method of claim 6 wherein the controlling step comprises a step of limiting a rate of increase of hydraulic fluid pressure or flow to the at least one other actuator, after initiating the step of controllably snubbing the first actuator.

8. The method of claim 6 wherein the step of controlling hydraulic fluid pressure or flow comprises controllably snubbing the first actuator at a snubbing rate that is mapped to the determined value.

9. The method of claim 6 wherein the step of controlling hydraulic fluid pressure or flow comprises controllably snubbing the first actuator via a snubbing rate curve that is based at least in part on a direction, position and determined velocity of the first actuator.

10. A method of operating a machine having a work implement system comprising the steps of:

moving a work implement via a first actuator of the work implement system, the first actuator having a range of motion;

sensing a stroke condition of the first actuator; and ameliorating an end of stroke effect on at least one other actuator of the work implement system, if an end of stroke condition of the first actuator is sensed wherein the first actuator and the at least one other actuator are hydraulic actuators of a hydraulic work implement system, the ameliorating step comprising a step of controlling hydraulic fluid pressure or flow to the at least one other actuator;

wherein the step of controlling hydraulic fluid pressure or flow comprises slowing the first actuator as it approaches an end of its stroke;

wherein the step of controlling hydraulic fluid pressure or flow comprises a step of controllably snubbing the first actuator:

wherein the first actuator is an estick actuator of a work implement linkage, and the at least one other actuator comprises a boom actuator or a bucket actuator of the work implement linkage;

wherein the moving step comprises a step of distributing a work material; and wherein the ameliorating step comprises a step of controllably snubbing the estick actuator via an adjustable valve at a predetermined snubbing rate based at least in part on a determined velocity of the estick actuator as it approaches an end of stroke position.

11. A machine comprising:

a work implement system including a linkage, a work implement connected with said linkage, and first and second actuators operably coupled with said linkage; and an electronic controller including means for sensing a stroke condition of said first actuator, and means for ameliorating an end of stroke effect induced by said first actuator on said second actuator, if an end of stroke condition of said first actuator is sensed, said means for ameliorating further including means for limiting increasing fluid pressure or flow to said second actuator.

12. A machine comprising:

a work implement system including a linkage, a work implement connected with said linkage, and first and second actuators operably coupled with said linkage; and an electronic controller including means for sensing a stroke condition of said first actuator, and means for ameliorating an end of stroke effect induced by said first actuator on said second actuator, if an end of stroke condition of said first actuator is sensed, said means for ameliorating further including means for limiting increasing fluid pressure or flow to said second actuator;

said linkage includes a stick and a boom;

said first and second actuators comprise a hydraulic estick actuator and at least one hydraulic boom actuator, respectively coupled with the stick and boom; and said means for ameliorating includes means for controlling a hydraulic fluid pressure or flow to said at least one boom actuator at least in part by slowing said estick actuator as it approaches an end of its stroke.

13. The machine of claim 12 further comprising an adjustable snubbing valve operably associated with said estick actuator, wherein said means for controlling comprises means for controllably snubbing said estick actuator via said valve.

14. The machine of claim 13 further comprising a position sensor in communication with said electronic controller and operable to sense the stroke condition of said estick actuator.

15. A machine comprising:

a work implement system including a linkage, a work implement connected with said linkage, and first and second actuators operably coupled with said linkage; and an electronic controller including means for sensing a stroke condition of said first actuator, and means for ameliorating an end of stroke effect on said second actuator, if an end of stroke condition of said first actuator is sensed;

said linkage includes a estick and a boom;

said first and second actuators comprise a hydraulic estick actuator and at least one hydraulic boom actuator, respectively coupled with the stick and boom; and said means for ameliorating includes means for controlling a hydraulic fluid pressure or flow to said at least one boom actuator at least in part by slowing said estick actuator as it approaches an end of its stroke the machine further comprising an adjustable snubbing valve operably associated with said estick actuator, wherein said means for controlling comprises means for controllably snubbing said estick actuator via said valve; and the machine further comprising a position sensor in communication with said electronic controller and operable to sense the stroke condition of said estick actuator;

wherein said electronic controller further includes means for determining a value indicative of a velocity of said first actuator at least in part via an output signal from said position sensor, said means for controlling comprising means for controllably snubbing said first actuator at a rate that is based at least in part on the determined value.

16. The machine of claim 15 wherein said means for controlling includes a map having at least an actuator velocity coordinate and a snubbing rate coordinate.

17. The machine of claim 15 wherein said means for controlling includes means for curve fitting a snubbing rate for said first actuator to velocity, position and a travel direction thereof.

18. An electronic controller comprising:

means for sensing a stroke condition of an actuator in a work implement system of a machine, and means for ameliorating an end of stroke effect induced by the actuator on at least one other actuator of said work implement system where an end of stroke condition is sensed, said means for ameliorating further including means for limiting increasing fluid pressure or flow to said at least one other actuator.

19. The electronic controller of claim 18 wherein said means for ameliorating further includes means for controlling a snubbing valve for said actuator.

20. An electronic controller comprising:

means for sensing a stroke condition of an actuator in a work implement system of a machine, and means for ameliorating an end of stroke effect on at least one other actuator of said work implement system where an end of stroke condition is sensed;

wherein said means for ameliorating includes means for controlling a hydraulic fluid pressure or flow to the at least one other actuator of said work implement system;

said electronic controller further comprising means for determining a value indicative of a velocity of said actuator, said actuator being a first actuator, and wherein said means for controlling hydraulic fluid pressure or flow to the at least one other actuator includes means for snubbing said first actuator at a predetermined rate.

* * * * *